United States Patent [19]

Battis

[11] 3,949,992

[45] Apr. 13, 1976

[54] TENNIS SIMULATING TABLE GAME

[76] Inventor: Larry J. Battis, 702 Claymont Estates, Ballwin, Mo. 63011

[22] Filed: Feb. 13, 1974

[21] Appl. No.: 442,074

[52] U.S. Cl. ..... 273/134 CB; 273/134 B

[51] Int. Cl.[2] ..... A63F 3/00

[58] Field of Search..... 273/85 R, 134 AG, 134 CB, 273/134 DB, 134 CA, 134 CF, 134 AC, 130 G, 130 B, 134 ES; 46/DIG. 1

[56] References Cited

UNITED STATES PATENTS

| | | | |
|---|---|---|---|
| 439,425 | 10/1890 | Presbrey | 273/85 R |
| 1,102,954 | 7/1914 | Ries et al. | 273/85 R |
| 2,586,039 | 2/1952 | Heggedal | 273/130 B |
| 2,757,933 | 8/1956 | Gilmour | 273/134 AC |
| 2,886,319 | 5/1959 | Henderson | 273/134 CA |
| 3,545,763 | 12/1970 | Seitz | 273/134 CA |
| 3,659,851 | 2/1972 | Lang et al. | 273/130 B |
| 3,853,322 | 12/1974 | Mercer | 273/134 ES |

FOREIGN PATENTS OR APPLICATIONS

| | | | |
|---|---|---|---|
| 1,217,728 | 12/1970 | United Kingdom | 273/134 CA |
| 504,541 | 4/1939 | United Kingdom | 273/134 CB |
| 790,150 | 9/1935 | France | 273/134 CA |
| 922,097 | 1/1947 | France | 273/85 R |
| 923,695 | 2/1947 | France | 273/85 R |
| 1,013,524 | 4/1952 | France | 273/85 R |

*Primary Examiner*—Anton O. Oechsle
*Assistant Examiner*—Harry G. Strappello
*Attorney, Agent, or Firm*—Rogers, Eilers & Howell

[57] ABSTRACT

A tennis simulating table game has a board representing a court, divided into halves, with each half divided into zones and each zone into sections. There are a group of player-representing tokens that have different playing strengths and weaknesses designated on them, one selected by each player, which thereafter qualify his play. There are transparencies, one for each player, shaped to overlie certain board sections he can cover either surely, weakly, or not at all. There are groups of cards that contain different results of the serves and returns to indicate where they land. Dice are used to develop numbers, and there is a chart giving ranges of small numbers that represent success or failure of the players in making the shots. The receiving player returns the ball if it is in certain sections near him, fails if it is in other sections, and rolls the dice if it falls in still other sections. His chances of return on these last sections depend on the dice values he rolls, as related to his strength or weakness shown in his token. A similar procedure with cards and dice is used for the receiver player's return volley, and so forth. A special card used in the volley play has dice values for special results.

14 Claims, 16 Drawing Figures

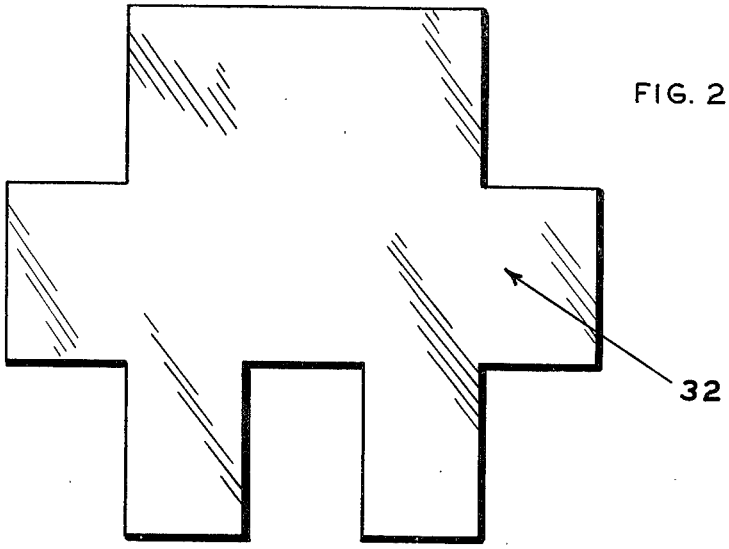
FIG. 2.
FIG. 16.
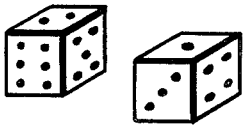
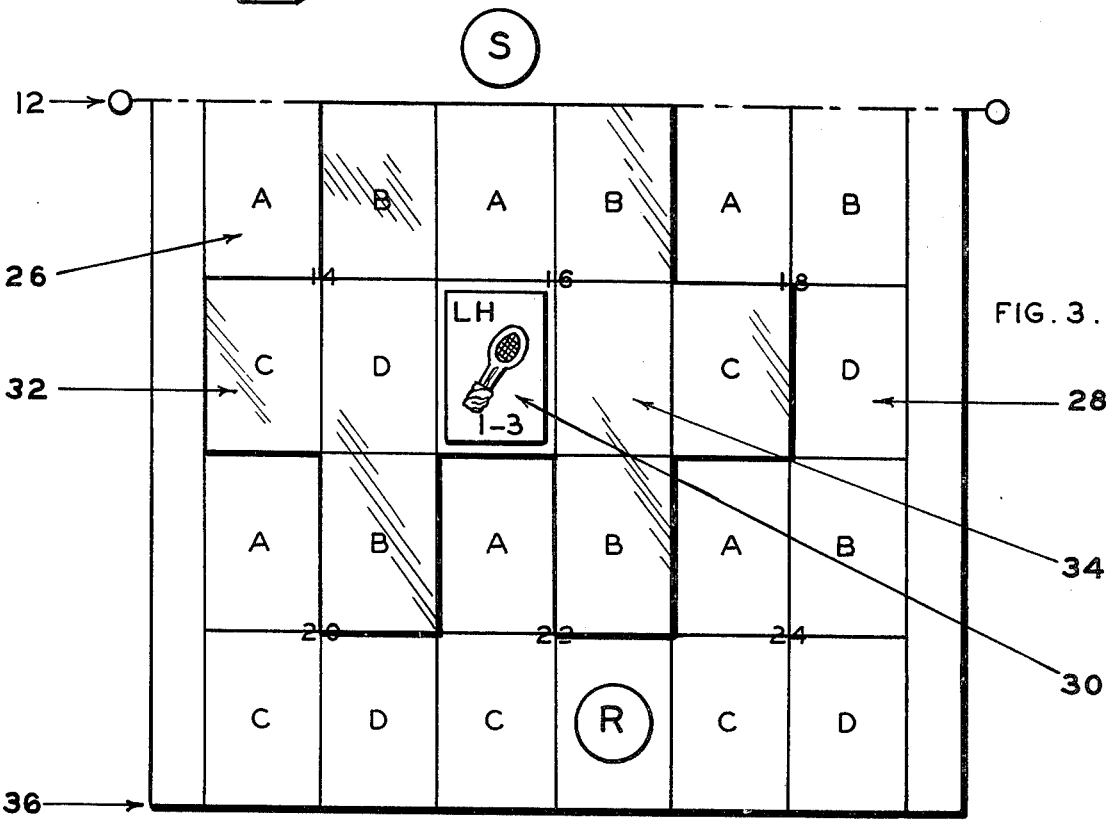
FIG. 3.

FIG. 11
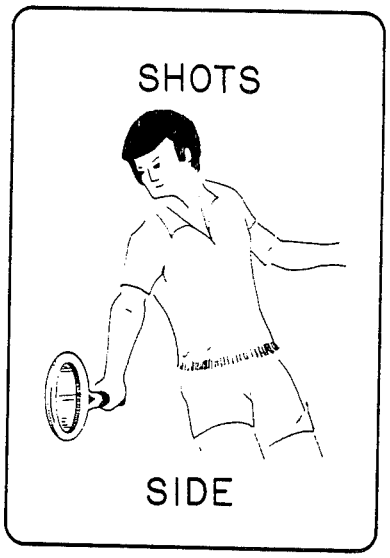
FIG. 12
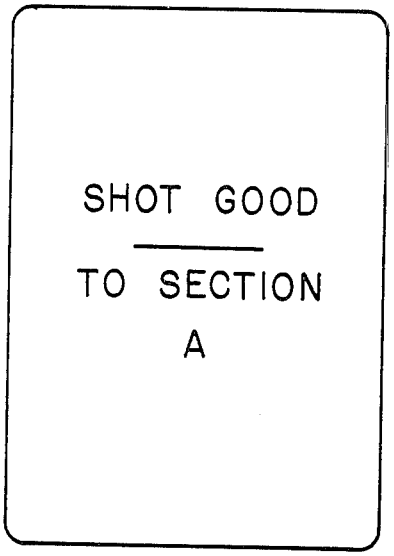
FIG. 13
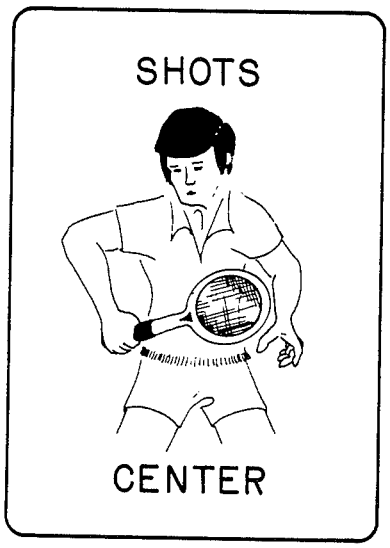
FIG. 14
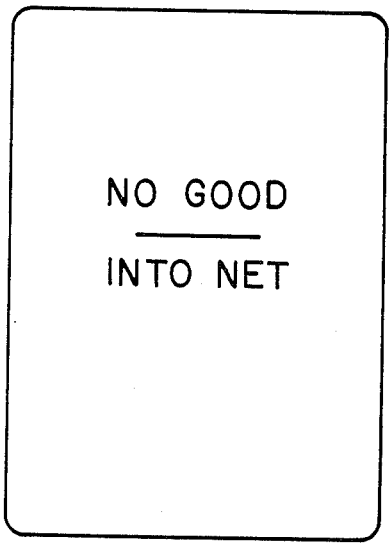
FIG. 15
| SPECIAL | | |
|---|---|---|
| 1 | 2 | 3 |
| 2-4,12 GOOD | 2-7,12 GOOD | 2-8,12 GOOD |
| 5-11 NO GOOD | 8-11 NO GOOD | 9-11 NO GOOD |

TENNIS SIMULATING TABLE GAME

BACKGROUND AND SUMMARY OF THE INVENTION

Table games, especially the table games which simulate athletic games, are well-known to the public generally. These athletic table games are normally played with tokens used to represent the players of the athletic game and the game proceeds following as closely as may be the rules and scoring of the athletic game simulated.

Tennis simulating games are known in which the rules follow the normal rules of play and scoring for tennis. However, in these former games it is not possible to weigh the simulated play to account for relative skills of the players playing the game. It has not been possible in previous games to provide a movable area of influence of the player which would simulate the movement and reach of an actual player.

One simulated tennis game uses a board divided into sections, dice and a rules chart. In it the server does not have to designate the section into which his serve is to go, and there are no dice number differences based upon the position of the selected section. It also lacks the requirement that the receiver position himself without knowing where the volleying player plans to return the ball. These differences are to some extent due to the lack of cards in that game, which in applicant's game may be selected by a player, and confine him to certain results, but are not disclosed to his opponent until his opponent has taken a position. With player's mobility limited, such pre-commitment is important. There are other differences, including the absence of bonus or special cards that can impose additional dice throw odds on the success or failure of a volley. Also it lacks a placement device that shows the area a player may cover.

The present simulated tennis table game allows the players to utilize the scoring rules of the athletic game of tennis. The game has a ball image, tokens chosen to represent the players, the tokens showing handicaps with respect to the token-player's skills in service and volley, the handicap rating of the tokens influencing the play of the game. Thus it is an object of the game to have each player given a preselected handicap at the outset of the game.

The tokens are affixed to a space-occupying member during the play of the game. The space-occupying member defines, in movement over the playing surface, the area of influence of the player on the board analogous to the reach of an actual tennis player. This gives a quickly readable representation to the players of the ability of a receiver to handle shots coming to him. Play of the game alternates just as the stroke of the game of tennis alternates between opponents. Placement of the service and shots of the game is determined by placement-designating instruction cards. It is an object of the invention to provide areas into which a shot is directed in accordance with a card drawn from a deck by an opponent, which areas are divided into different parts, and the ability of the receiving player to return the play is determined by the dice values, under at least some circumstances.

Scoring in the play of the game is determined by odds, generated numerically by rolling the dice, in cooperation with the instructions on the cards and the handicap rating of the player-tokens.

DESCRIPTION OF THE DRAWINGS

FIG. 2 is of a transparent space-occupying member;

FIG. 3 is a partial view of the playing surface showing the relationship of the space-occupying member to the sections of the playing surface;

FIG. 11 is a view of a side zone shot card;

FIG. 12 is a view of a side zone shot card showing a sample instruction;

FIG. 13 is a view of a center zone shot card;

FIG. 14 is a view of a center zone shot card showing a sample instruction;

FIG. 15 is a view of a side zone special shot card showing the instructions; and FIG. 16 is a pair of conventional dice used during play of the game.

DESCRIPTION OF THE PREFERRED EMBODIMENT

Figure 1:
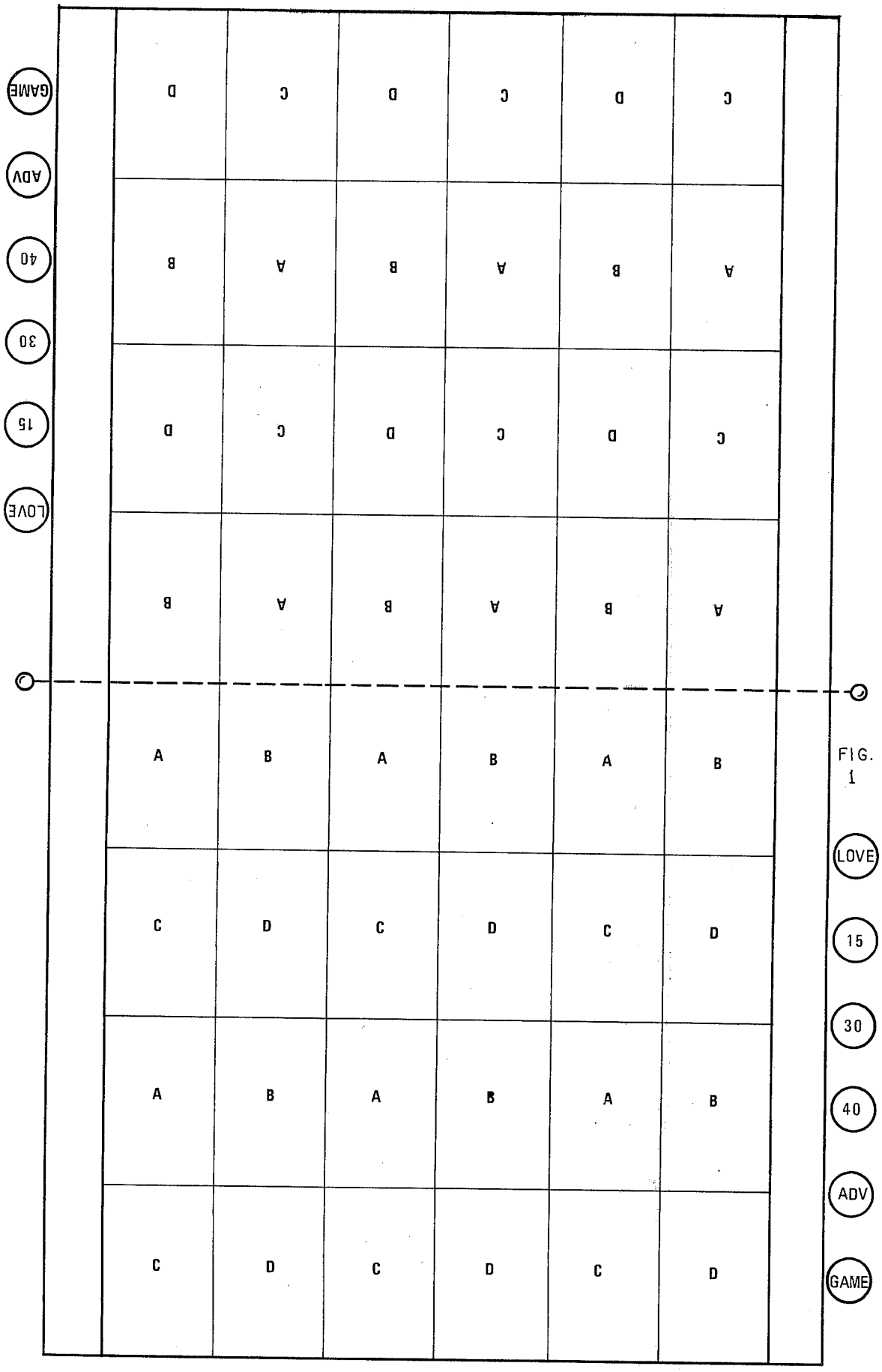
FIG. 1 is a drawing of the playing surface on the board in the form of a miniature tennis court divided into sections.

The playing surface, shown in FIG. 1, is a flat area 10 divided into 48 sections in an array six sections wide by eight sections long. The board is divided into halves by a net line 12, each half containing 24 sections in an array six sections wide by four sections long. The sections in each half are divided into six zones 14, 16, 18, 20, 22 and 24, with each zone containing four sections, the sections in each zone being lettered A, B. C, D, as shown in FIG. 1. The six zones correspond to the six basic zones in the game of tennis, that is, zone 14 corresponds to the left fore court, zone 16 corresponds to center fore court, zone 18 corresponds to right fore court, zone 20 corresponds to left back court, zone 22 corresponds to center back court and zone 24 corresponds to right back court.

Typical service court lines divide each half court. Fore court zones 14, 16 and 18 are divided by the lines into two service receiving areas; all of zone 14 plus sections A and C of zone 16 make up the left service receiving area 26, right service receiving area 28 is made up of all of zone 18 plus sections B and D of zone 16.

Other equipment required for the game is a pair of regulation dice (shown in FIG. 16), an object 34 representing a tennis ball and an array of tokens, from which the opposing players each select one. A typical token is shown at 30 in FIG. 3. As there illustrated, the token is a small handy object, with a designation of "LH" or "RH" meaning a left handed or a right handed player. It also has a pair of numbers, "1–3" in the illustration. The first number represents the quality or rating of the player's service, and the second number represents the rating of his volley. 1 is a low rating, 2 medium, 3 is high. The array of tokens is set out in Table I and consists of three tokens rated left handed and three tokens rated right handed. As shown, the service and volley ratings progress in inverse order, from 1 to 3. This doubling up on the service cards is possible because the six sections of one service court correspond to the six sections of the other.

No token can have a high handicap rating in both volley and service. The serve handicap rating cooperates with a service chart. Table II is the Service Chart.

TABLE I

| ARRAY OF PLAYER TOKENS | | |
|---|---|---|
| Hand Rating | Service Rating | Volley Rating |
| Left | 1 | 3 |
| Left | 2 | 2 |
| Left | 3 | 1 |
| Right | 1 | 3 |
| Right | 2 | 2 |
| Right | 3 | 1 |

TABLE II

| SERVICE CHART | | | | | | |
|---|---|---|---|---|---|---|
| | Instruction per value of dice roll | | | | | |
| Service Card Selected (see Table III) | Player service rating 1 | | Player service rating 2 | | Player service rating 3 | |
| | shot good | shot no good | shot good | shot no good | shot good | shot no good |
| 1 | 2–4 | 5–12 | 2–5 | 6–12 | 2–6 | 7–12 |
| 2 | 2–4 | 5–12 | 2–5 | 6–12 | 2–6 | 7–12 |
| 3 | 2–6,12 | 7–11 | 2–7,12 | 8–11 | 2–8,12 | 9–11 |
| 4 | 2–6,12 | 7–11 | 2–7,12 | 8–11 | 2–8,12 | 9–11 |
| 5 | 2–5,12 | 6–11 | 2–6,12 | 7–11 | 2–7,12 | 8–11 |
| 6 | 2–5,12 | 6–11 | 2–6,12 | 7–11 | 2–7,12 | 8–11 |

Figure 7:
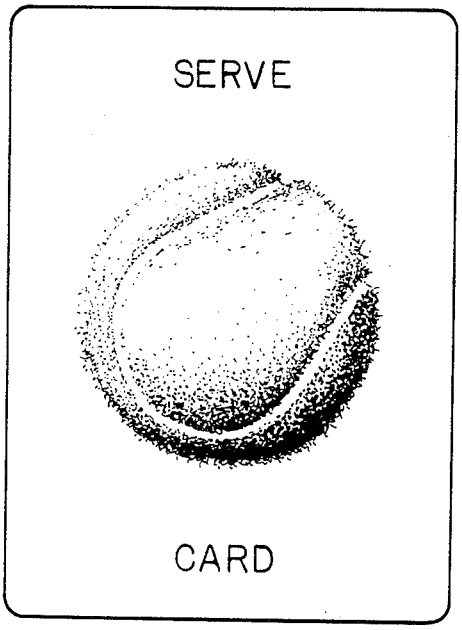
FIG. 7 is a view of a service card.
Figure 8:
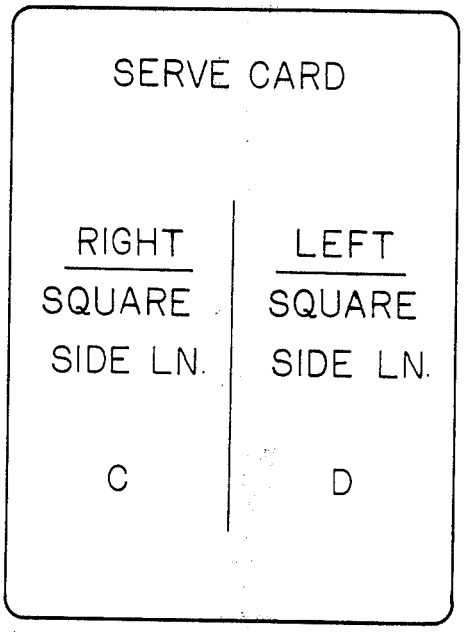
FIG. 8 is a view of a service card, showing the selected service section.

Play of the game is controlled by a set of service cards, a set of volley zone cards, and two sets of shot cards. The set of service cards contains six cards which correspond to each of six sections of each service receiving area. A typical service card is shown in FIGS. 7 and 8. On its reverse side it has only an indication that it is a serve card. On its face it has two columns, one for right side serves, the other for left side serves. In each column is a letter designating the particular one of the six sections of the service area, right or left, into which the starting player aims to serve. The designations "Right Square" and "Left Square" represent the right or left service courts as viewed by the Server. For example, the server at the start of a conventional tennis game serves into the left side service court on the server's left (but the receiver's right). Table III shows the sections designated by the several service cards. In the right service courts 26, there are a side line section A as well as a center line section A so there are serve cards thus differentiating these sections A. Similarly there are cards differentiating the sections C as either "center line" or "side line" C. There are only single sections B and D so the serve card for these requires no further identification. Comparable cards designate the sections of the left serve courts 28.

Figure 9:
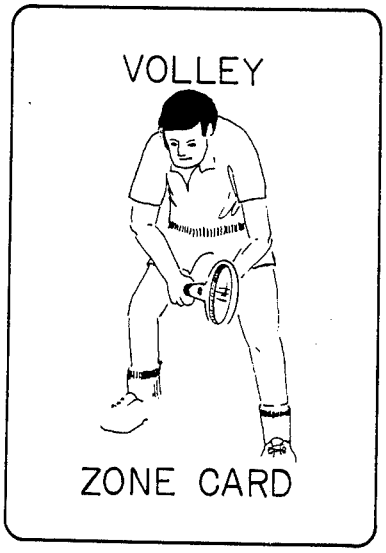
FIG. 9 is a view of a volley zone card.
Figure 10:
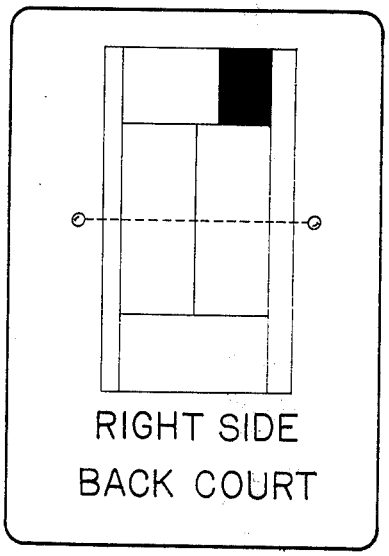
FIG. 10 is a view of a volley zone card showing the selected volley zone.

A second array of cards consists of six volley zone cards, one of which is shown in FIGS. 9 and 10. Their back sides are blind. Each face has a designation of one of the court zones 14, 16, 18, 20, 22 0r 24. Each volley zone card designates one of the six.

TABLE III

| ARRAY OF SERVICE CARDS | | |
|---|---|---|
| CARD | Service receiving area target section | |
| | Serving Left Side | Serving Right Side |
| 1 | side line section 18B | side line section 14A |
| 2 | center line section 16B | center line section 16A |
| 3 | center section 18A | center section 14B |
| 4 | center section 18C | center section 14D |
| 5 | side line section 18D | side line section 14C |
| 6 | center line section 16D | center line section 16C |

TABLE IV

| VOLLEY ZONE CARDS | |
|---|---|
| CARD | Target Volley Zone |
| 1 | left fore court |
| 2 | left back court |
| 3 | center fore court |
| 4 | center back court |
| 5 | right fore court |
| 6 | right back court |

Table IV shows the zones designated by each of the volley zone cards. The third group of cards are two shot card sets. The shot card sets consist of a set of six cards for the left and right court zones 14, 20, 18 and 24, and a set for the center court zones 16 and 22. Typical cards are shown at FIGS. 11–15. On their backs the shot card sets are marked center or side. On their faces, each set has a card indicating a "good" shot to one of the sections A, B, C or D. In addition each set has four "No Good" shot cards. The side zone shot card set has one special card shown in FIG. 15 having three columns for the three different ratings of players. In each column are dice counts designating whether a shot is "Good" or "No Good". Table V shows the makeup of the sets of shot cards. The value of the special card is shown in Table VI.

Each player is supplied with a transparent spaceoccupying member 32 shown in FIGS. 2 and 3 which is adapted to overlie 10 of the 24 sections of each player's playing surface. The overlay is movable about the playing surface and defines the area of each of each player token. The player token is adapted to be removably attached to the transparent space-occupying member.

THE PLAY OF THE GAME

To play the game, each player picks a token of his choice, i.e., either a right or left handed token (RH or LH on the token) with either a strong serve or a strong backhand or a balance of the two, as shown by the ratings on the tokens whereon the first number is the serve rating and the second number is the volley rating, see Table I and FIG. 3.

TABLE V

| SHOT CARD ARRAY AND INSTRUCTIONS | | | | |
|---|---|---|---|---|
| Volley Zone Card Selected | Shot Card | Instructions | | |
| | 1 | shot good to | section | A |
| left fore court 14 | 2 | " | " | B |
| | 3 | " | " | C |
| left back court 20 | 4 | " | " | D |
| | 5 | shot no good | - wide | |
| right fore court 18 | 6 | " | -into | net |
| | 7 | " | " | " |
| right back court 24 | 8 | " | " | " |
| | 9 | special | | |
| center fore court 16 | 1 | shot good to | section | A |
| | 2 | " | " | B |
| center back court 22 | 3 | " | " | C |
| | 4 | " | " | D |
| | 5 | shot no good | - into | net |
| | 6 | " | " | " |
| | 7 | " | " | " |

TABLE VI

| VOLLEY SPECIAL CARD | | |
|---|---|---|
| Player token volley rating | Instruction per value of dice roll shot good | shot no good |
| 1 | 2–4, 12 | 5–11 |
| 2 | 2–7, 12 | 8–11 |
| 3 | 2–8, 12 | 9–11 |

The strengths and weaknesses of the token are in numerical ratings ranging from 1-poor to 3-excellent.

Each player also selects a transparent space-occupying member 30. The space-occupying member 30, to which the playing token may be removably attached by conventional adhesive means, or by incorporating a transparent envelope in the space-occupying member, represents the zone of control or reach of the player-token when at any position on the court. The transparency need not be connected with the token until after serve has been completed. Each token can move only a maximum of two sections on the board in any direction, or combination of directions. However, he need not move at all. The exception to the token movement is when a player is serving, he is allowed to move three squares maximum.

Figure 4:
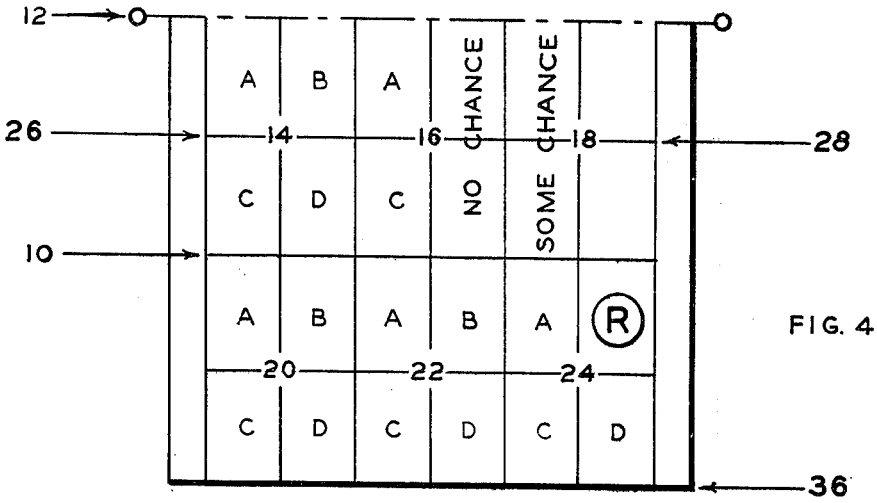
FIG. 4 is a view of the playing surface showing the relationship of the receiver to the service receiving area.
Figure 5:
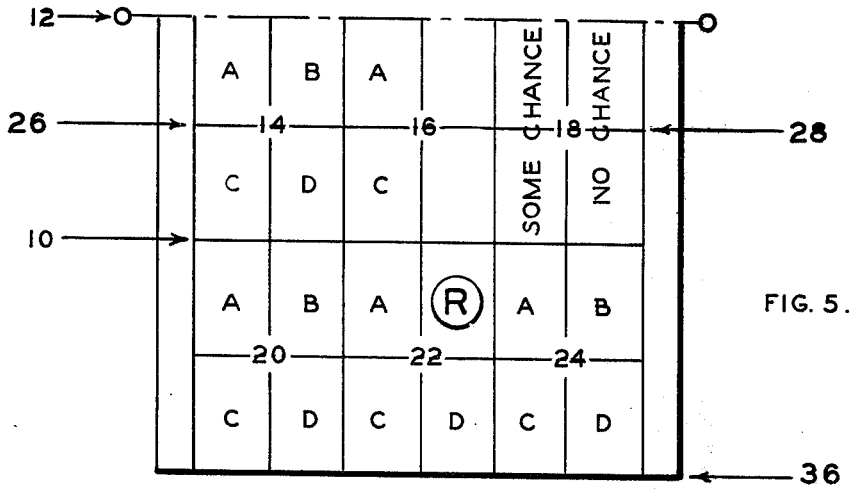
FIG. 5 is another view of the playing surface, showing the relationship between the receiver and the service receiving area.

Server S starts by positioning his token behind base line 36, serving to his right if he is righthanded and to his left if he is lefthanded. The server S chooses a Serve Card representing one of the six lettered sections in the serve-receiving area 26 or 28 to which section he wishes to aim the ball, and then places it face down in front of him. Then the receiver R chooses one of the three sections immediately behind the serve receiving area in which he will position himself (right, left or center) for the serve, see FIGS. 4, 5 and 6. After the receiver R has moved his token into position, the server S then reveals his selection of Serve Card, and rolls the two dice. Adding the spots on the dice to get a dice count, player A consults the service chart (Table II) under the proper columns for the first serve. The table tells the players whether the dice count obtained represents a "Good" or "No Good" serve for the particular section selected by the server's Serve Card. If the serve is good, e.g., clears the net, the object (ball) 34 is placed in the section chosen. If the serve is no good, server S has faulted, in which event the procedure is repeated until the server S either gains his second fault, which is a point for the receiver R, or the serve clears the net resulting in either an ace for the server S, his point, or a return and volley, as will appear.

Once the ball 34 clears the net and lands in the chosen section, the positioning of the receiver R comes into effect. It will be remembered that the receiver R selected his position before the serve. If the receiver R has placed his token in section 24B, to receive a serve to the sideline of service receiving area 28, he covers the two sections 18B and 18D in a straight line directly in front of his token up to net, with some chance at covering the center two sections 18A and 18C to his left in a straight line to the net. The receiver R has no chance at covering the two sections 16B and 16D near the center line, see FIG. 4. So there are three conditions: one is a sure return, the second a possible return, the third is no return.

If the receiver R places his token in the section 22B closest to the center line of the serve-receiving area 28, he controls the two sections 16B and 16D immediately in front of him in a straight line to the net, with some chance at the two center sections 18A and 18C to the right in a straight line to the net. The receiver R has no chance at covering the two sections 18B and 18D near the side line, see FIG. 5. This again poses the three conditions for return of the ball.

Figure 6:
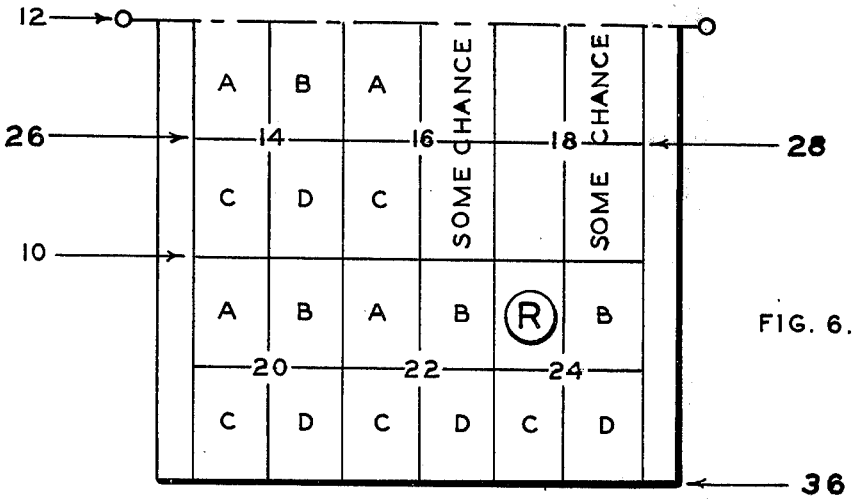
FIG. 6 is a third view of the playing surface showing the relationship between the receiver and the service receiving area.

If the receiver R positions himself in section 24A he covers the two sections 18A and 18C directly in front of him in a straight line to the net, with some chance at each of the two sections 16B and 16D on his left and the two sections 18B and 18D on his right, see FIG. 6.

If the serve places the object (tennis ball) 34 in the sections where the receiver has no chance (in FIGS. 4 and 5, two sections away from the token), it is an automatic ace for the server S. If the ball 34 lands in the sections with some chance, the chance is determined by whether it is the receiver's R backhand and a weakness or the receiver's R forehand and the results of rolling the dice. If it is the receiver's R forehand, the dice numbers 2–8 give a return by the receiver R and numbers 9–12 give a point for server S. If the section occupied by the ball is on the receiver R's backhand side, the receiver R's volley rating is consulted, it being remembered that this was selected at the start and is set out on the player's token. Table VII gives the instructions for backhand volley strokes.

TABLE VII

| BACKHAND VOLLEY STROKE INSTRUCTIONS | | | | | |
|---|---|---|---|---|---|
| Instruction per value of dice roll | | | | | |
| Player volley rating 1 | | Player volley rating 2 | | Player volley rating 3 | |
| return serve | point for server | return serve | point for server | return serve | point for server |

TABLE VII-continued

| BACKHAND VOLLEY STROKE INSTRUCTIONS Instruction per value of dice roll | | | | | |
|---|---|---|---|---|---|
| Player volley rating 1 | | Player volley rating 2 | | Player volley rating 3 | |
| 2–4, 12 | 5–11 | 2–6, 12 | 7–11 | 2–8 | 9–12 |

Thus, if the dice number is 5, and the player had a volley rating of 2, he can return the ball; but if the dice number is 7, he would not return, and would yield a point to the server S. If there is a successful return, either an automatic return or by chance, then the game proceeds to the return volley.

At the start of the volley, both players R and S attach their tokens to their space-occupying transparencies, see FIG. 3. The receiver R places his transparency with the token along side of the ball 34 for either forehand or backhand (determined by his position and where the ball lands) by moving his token one or two sections from its initial position, see FIG. 3. The receiver R then chooses one of the six volley zone cards (see Table IV) corresponding to one of the six zones 14, 16, 18, 20, 22 or 24 to which the receiver R would like to place his return shot. The receiver R places the card face down in front of him. The server S may move his token 1, 2 or 3 sections to position for the volley, but server S must move at least one section to place himself in the court.

After the server S positions his playing token, then the receiver R turns his zone card face up and reveals his zone choice. He then picks a card at random from the proper shuffled set of "shot" cards for that zone, see Table V. For example, all shots to zones 14, 18, 20 and 24 require a selection from the side "shots" set. Shots to center zones 16, 22 require selection from the "shots center" set. The two sets of cards are kept reshuffled after each selection. Each set of shot cards has four cards, one representing a good shot into each of the four squares of the chosen zone (A, B, C, D) and three or four cards instructing the player shooting (receiver R) that his shot is not good (wide or net) so that a point results for his opponent (server S), see Table V.

The side court set also has a special card which is similar to a bonus card, see Tables V and VI. The special card operates in cooperation with the token's volley rating. The special card favors a high volley rating. If the player draws the "special" card, then he must roll the dice. He reads the dice numbers in the column on the special card corresponding to his volley rating shown on his token. The numbers corresponding to his dice number tell whether his return is good or no good. After each draw, the cards in the set are reshuffled.

If the shot card directs the ball 34 to a section not covered by the opponent's (server S) space-occupying transparency, a point results for the shooter (receiver R). If the ball lands on the section occupied by the opponent's (server S) token, the shot is a jam and a point results for the shooter (receiver R). If the ball lands in any other section covered by the opponent's (server S) space-occupying transparency, the volleying procedure is repeated with the opposing player (server S) positioning his token, and choosing his zone and the other player (receiver R) positioning for the return volley. The stroke continues to alternate until a point results.

When the shooting player token is up at the net, his control extends over the net to the three sections in front of him covered by his space occupying transparency. If the shooter's shot lands in one of those three sections, the shot is an automatic jam with the point going to the shooter. All scoring follows tennis scoring rules. All other regular tennis rules apply. Scoring may be recorded by placing markers on scoring indicia 36, see FIG. 1.

It will be appreciated that one skilled in the art could modify the invention disclosed to vary the form or conduct of the game without departing from its basic concepts and structure. Applicant is not to be limited to the specific embodiments disclosed, but only by the scope of the appended claims.

What is claimed is:

1. In a simulated tennis game: a board or like means having court areas thereon physically divided into separately identified areas; player-selectable means including a plurality of devices accessible to the server, for his choice, the devices having different area designation indicia thereon on one side only, so that the server may pre-select one of them and by it designate an area to which he may direct a serve; and chance means to indicate whether or not he makes the serve reach the selected area.

2. In the tennis game of claim 1: the chance means providing different indicia depending on chance; a player-grading means for each player, the grading means setting the ability of the player in serving, and designating the indicia of the chance means appropriate to the graded ability of the player.

3. In the tennis game of claim 2: the grading means providing graded abilities of the players in serving and in volleying with combinations of good serving — poor volleying, median serving — median volleying, and poor serving — good volleying.

4. In the tennis game of claim 1: the player-selectable means comprising a plurality of cards each having an area designation on one side only.

5. In the tennis game of claim 2: the chance means comprising dice, and a chart relating the die numbers to the player gradings to designate whether or not the player causes the ball to reach the designated area.

6. In the tennis game of claim 5: the chart providing for more successful die number combinations for players having better player service ratings.

7. In the tennis game of claim 6: the chance means being at least one die, the chart means having different die numbers for different graded abilities of the players, with more die numbers representing good shots by the higher graded players.

8. In the tennis game of claim 1: receiver-positioning means by which the receiver may select and indicate his receiving position before the serve, whereby conditions for his ability to return the ball may be predetermined by his selection

9. In the tennis game of claim 8: with chance means to indicate whether or not the receiver can return the ball, the chance means having different representations thereon, some of which can indicate a return possibility, and some not; the chance means being operable to select one or the other fortuitously.

10. In the tennis game of claim 9: the chance means including a first coding chart to indicate the possibility of a return from the receiver's forehand, for given representations of the chance means, and a second coding chart to indicate different possibilities of return from the receiver's backhand, for the said representations of the chance means.

11. In the tennis game of claim 8: selectable means by which the receiver selects a zone adjacent the server wherein he wishes to return the ball, and chance means operable by the receiver to determine whether he makes the return good or not.

12. In the tennis game of claim 11: the server having means to indicate his position for receiving the return before the disclosure of the zone selected by the receiver, such selection predetermining the server's chances of further returning the ball.

13. In the tennis game of claim 11 wherein the chance means operable by the receiver includes a bonus device having numbers representing successful and unsuccessful returns, and die means rollable to select the numbers by chance.

14. In the tennis game of claim 8: the receiver-positioning means comprising a sheet-like cover shaped to cover areas of the serve wherefrom the receiver is potentially able to return the ball.

* * * * *